United States Patent [19]

Ceelen et al.

[11] 4,436,054

[45] Mar. 13, 1984

[54] XEROGRAPHIC TONER CLEANING STATION

[75] Inventors: Theodorus M. Ceelen, LaVerne; Lothar S. Jeromin, Sierra Madre; Lamont R. Wright, Pasadena, all of Calif.

[73] Assignee: Xerox Corporation, Stamford, Conn.

[21] Appl. No.: 410,666

[22] Filed: Aug. 23, 1982

[51] Int. Cl.[3] ..... G03G 21/00

[52] U.S. Cl. ..... 118/652; 15/256.52; 355/10; 355/15

[58] Field of Search ..... 118/652; 355/10, 15; 15/256.52; 430/125

[56] References Cited

U.S. PATENT DOCUMENTS 4,311,780 1/1982 Mochizuki et al. ..... 355/15 X

FOREIGN PATENT DOCUMENTS 2034201A 6/1980 United Kingdom ..... 355/15

OTHER PUBLICATIONS

Newbury, D. M., *Cleaning Arrangement for Liquid Development Electrostatographic Imaging Apparatus,* Xerox Disclosure Journal, 6(1): p. 33, Jan./Feb. 1981.

*Primary Examiner*—Evan K. Lawrence

*Attorney, Agent, or Firm*—Robert E. Cunha

[57] ABSTRACT

A cleaning station for removing the residual toner from a dental x-ray sized photoreceptor plate after the image has been developed. The station comprises two sets of donor and foam cleaning rolls. The cleaning rolls are for removing toner particles from the plate, and the donor rolls are for transporting the cleaning liquid from a liquid delivery system to a nip between each donor and cleaning roll to create a standing wave of liquid at the nip and to flush away the toner particles.

6 Claims, 5 Drawing Figures

XEROGRAPHIC TONER CLEANING STATION

An improved cleaning station for cleaning residual toner from a xerographic plate after the image has been removed and, more specifically, a system of cleaning rolls which are supplied with a cleaning liquid for toner removal.

The described system, of which this cleaning station is a part is an automatic machine for the development of xerographic plates used for dental x-ray purposes. To create x-ray images of a patient's teeth, small xerographic plates which are sensitive to x-rays are used instead of the usual photographic film. To prevent exposure during handling, each plate is supplied with a cover which slides over the active surface. This cover fits into grooves around three edges of the plate to provide a light-tight seal, while the fourth side is closed, when the cover is in place, by a lip built into the plate itself. The plate is removed prior to development.

After development and image transfer, the active surface of the xerographic plate and the lip must be cleaned of toner at this cleaning station.

During the development and cleaning cycles, the plate is moved from one station to the next on a set of rails which engage the grooves of the plate on two edges. These rails limit the movement of the cleaning or foam roll. For this reason, two cleaning rolls are provided; a narrow roll for cleaning the lip and 90% of the active surface; the other, a full-width roll which is prevented by the rails from cleaning the lip, for cleaning the remainder of the active surface.

It would normally be assumed that a liquid that does not contain toner would be used as the cleaning liquid. However, in this system, the density of the toner in the liquid medium used for image development is so low that the same toner liquid can also be used as the cleaning liquid. This liquid is supplied to the cleaning rolls in sufficient quantity to constantly clean the rolls and carry away toner particles from the rolls back to the liquid toner reservoir. The use of the same toner liquid is a major advantage since a separate cleaning liquid supply need not be provided and periodically changed.

This invention will be more readily understood with respect to the following drawings.

Figure 1:
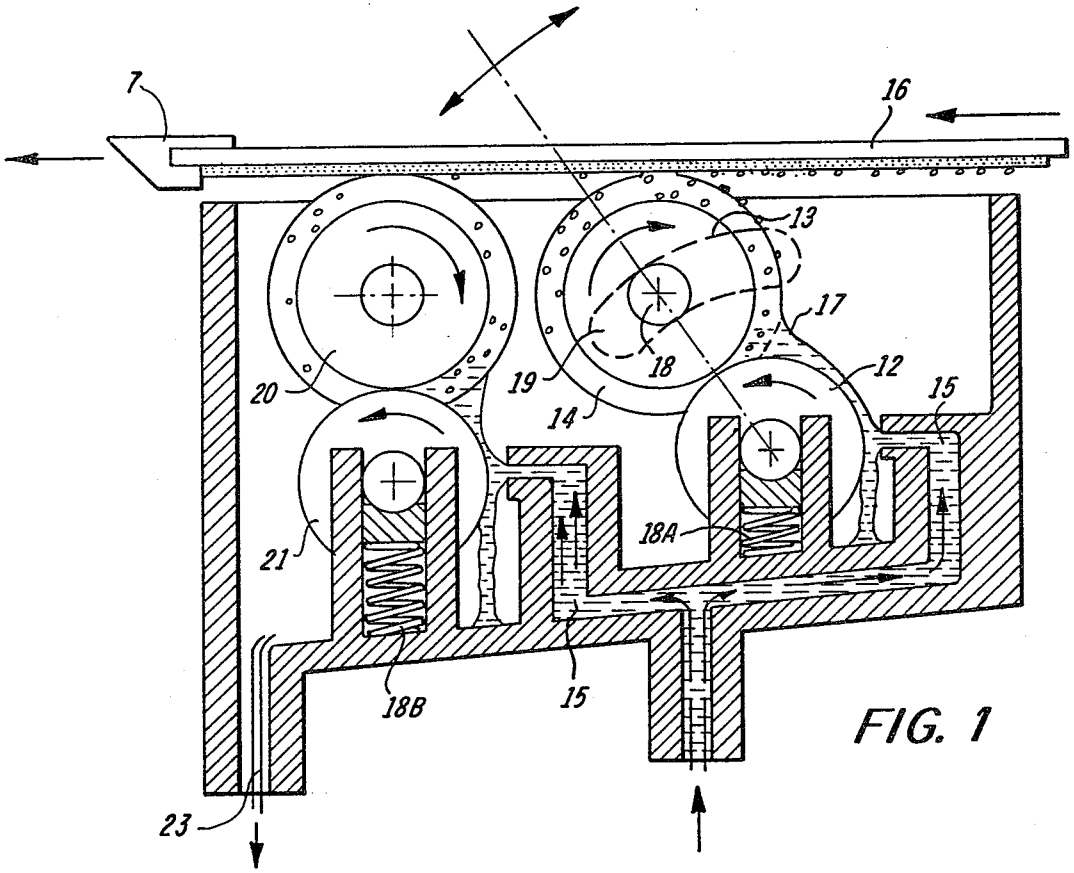
FIG. 1 is a schematic diagram of the station.

FIG. 1 is a simplified schematic drawing of the cleaning system, and shows the articulated set of rolls 12, 13. Cleaning roll 13 is a cylindrical plastic frame covered by a foam layer 14 of open cell polyurethane. Donor roll 12 is an uncovered aluminum cylinder.

A gear train drives roll 13 which, through of the line of contact at the nip between rolls, drives roll 12. Tubes 15 supply the cleaning liquid to a point midway between the ends of roll 12. The direction of rotation, counter clockwise at roll 12, then draws this liquid toward the nip to produce the standing wave 17 as shown between rolls 13 and 12.

At the same time, the xerographic plate 16, including lip 7, is being driven along rails, not shown, from right to left. Photoreceptor particles adhering to this surface will be wiped off into the foam cover 14 of roll 13. These particles will be carried along by the roll 13 to the standing wave 17. At this point, the liquid and particles flow to the bottom of the enclosure, and thereafter to be returned to the toner reservoir (not shown).

Roll 13 is articulated, the axis 18 being free to travel along slot 19 to accommodate passage of lip 7. In its usual position, as shown, it is in the proper position to clean the bottom surface of plate 16. However, when the lip 7 of the plate 16 first enters the cleaning station the roll will reposition upwardly and to the right, under the bias of a spring, not shown, to be in a position to clean the forward edge of the lip 7, and then gradually be forced lower and to the left to clean the remainder of the lip 7 and then the bottom of the plate 16.

Spring **18*a* presses upward against the center of roll 12 to maintain the proper pressure between rolls 12 and 13**.

The second set of rolls 20, 21 is identical except that the upper roll 20 is not articulated, but is set at the proper height to clean the bottom surface of plate 16. An additional difference is that roll 20 is wide enough to clean the entire bottom surface of plate 16. Articulated roll 13 cannot be made wide enough to clean the entire surface because the plate 16 rides on rails which mate with grooves in the plate 16 edges. The articulated roller 13 must therefore be narrow enough to pass upwardly between the rails to clean the under surface of lip 7, the forward edge of which is higher than the rails. The result is that articulated roll 19 is approximately 90% as wide as the plate 16, which leaves an uncleaned strip along each bottom edge of the plate 16. This is then cleaned by the full-width roll 20.

Figure 2:
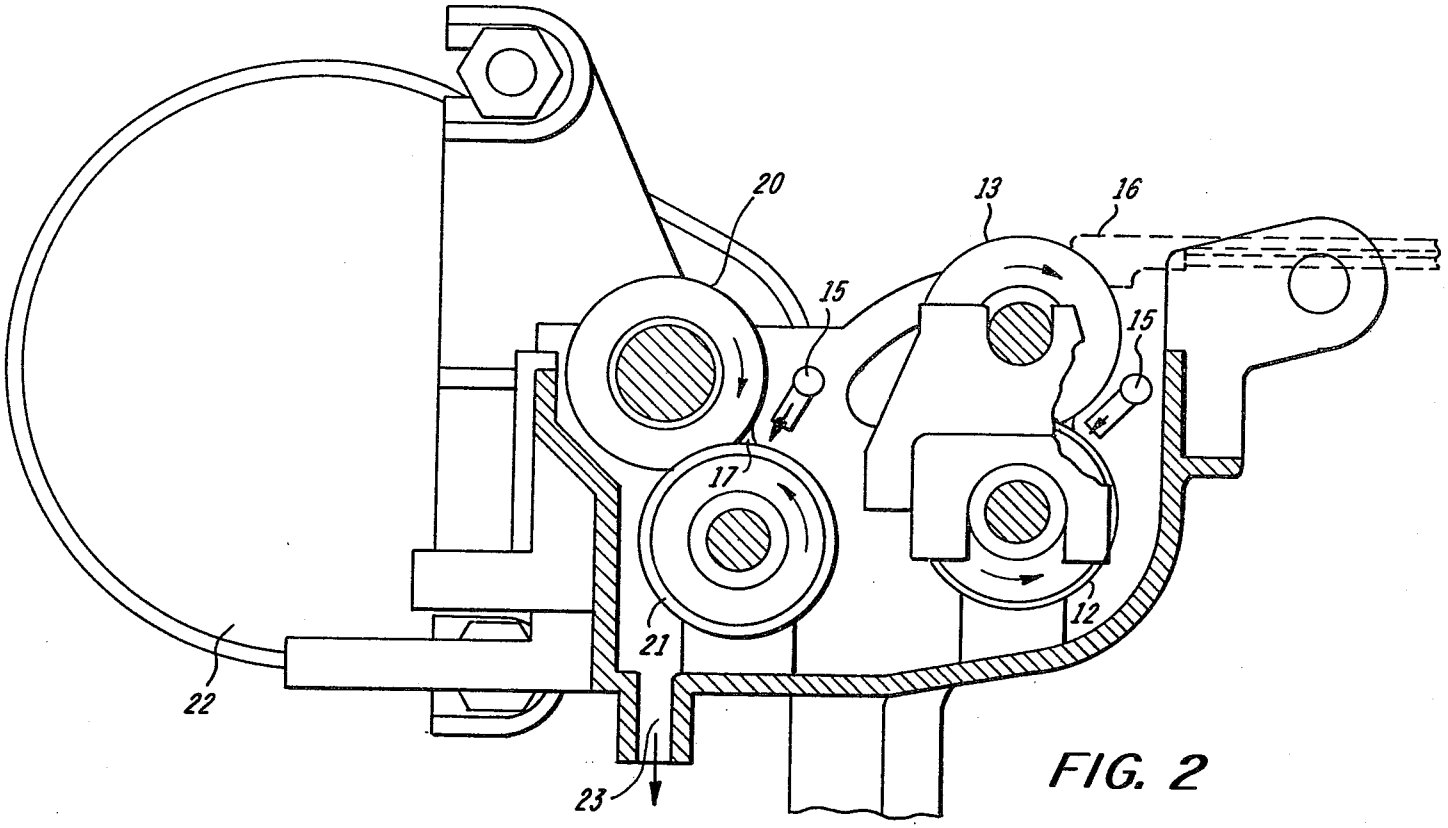
FIG. 2 is a side view showing the location of the rolls and the liquid drainage flow.

FIG. 2 shows the arrangement of the rolls 20, 21, 12, 13 in spatial relation to the remainder of the station. A motor 22 drives a gear train, not shown, which drives upper cleaning rolls 13 and 20. These, in turn, drive lower donor rolls 12 and 21. Tube 15 deposits a flow of liquid onto roll 21, as described above. A similar tube similarly supplies roll 12.

The plate 16, shows as four sets of dotted lines, enters from the right and contacts rolls 13 and 20 in that order. The liquid, from the standing wave 17 runs down to collect in the case, as shown, finally to be returned through a drain 23 to the reservoir.

Figure 3:
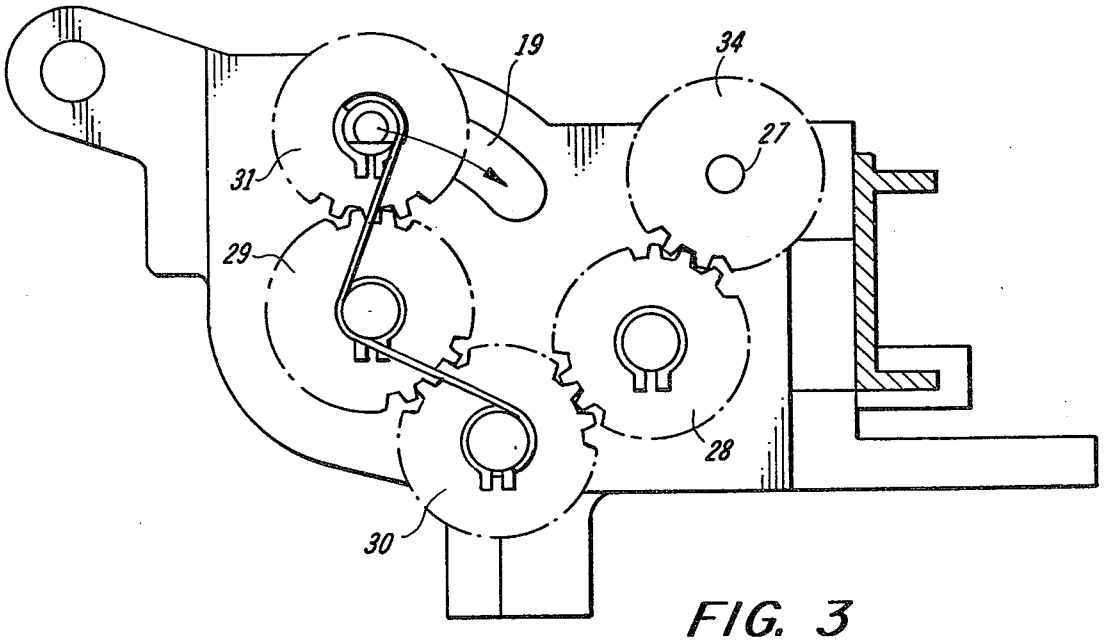
FIG. 3 is a side view showing the gear train.

FIG. 3 shows the gear train. The motor initially drives shaft 27 which is also directly connected to roll 20, not shown. Idler gears 28, 29 and 30 finally drive gear 31 which is directly connected to articulated roll 13, not shown. This arrangement of three idler gears is necessary to allow the articulated roll to travel along slot 19 and to allow rolls 13 and 20 to rotate in the proper directions.

Figure 4:
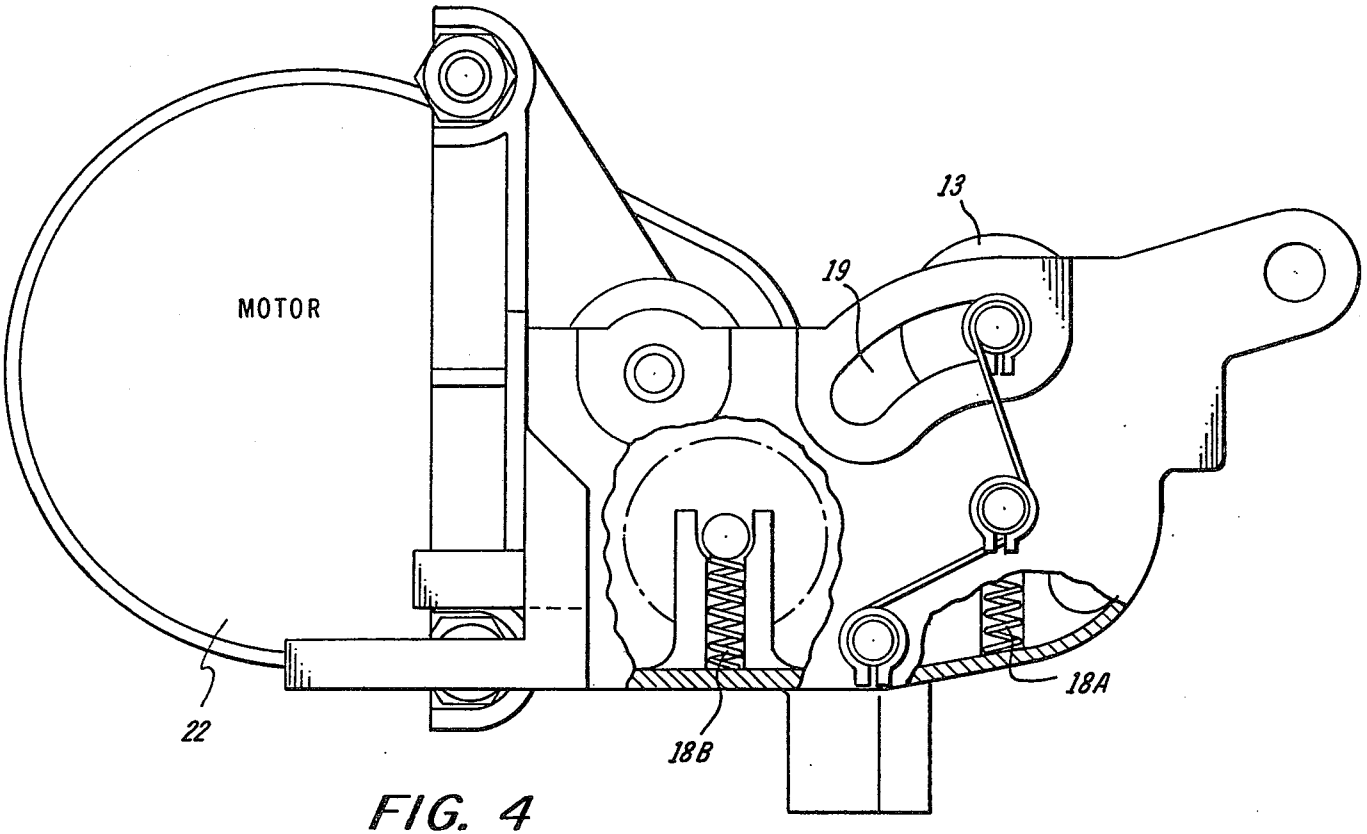
FIG. 4 is a side view showing the springs.

FIG. 4 more clearly shows the springs in the station. Springs **18*a* and 18*b* produce the correct amount of compression at the nip between rolls. Spring 33 drives articulated roll 13 in an upward direction in slot 19 which restrains the axis of said cleaning roll to travel along a line of points equidistant from the axis of said donor roll 12**.

Figure 5:
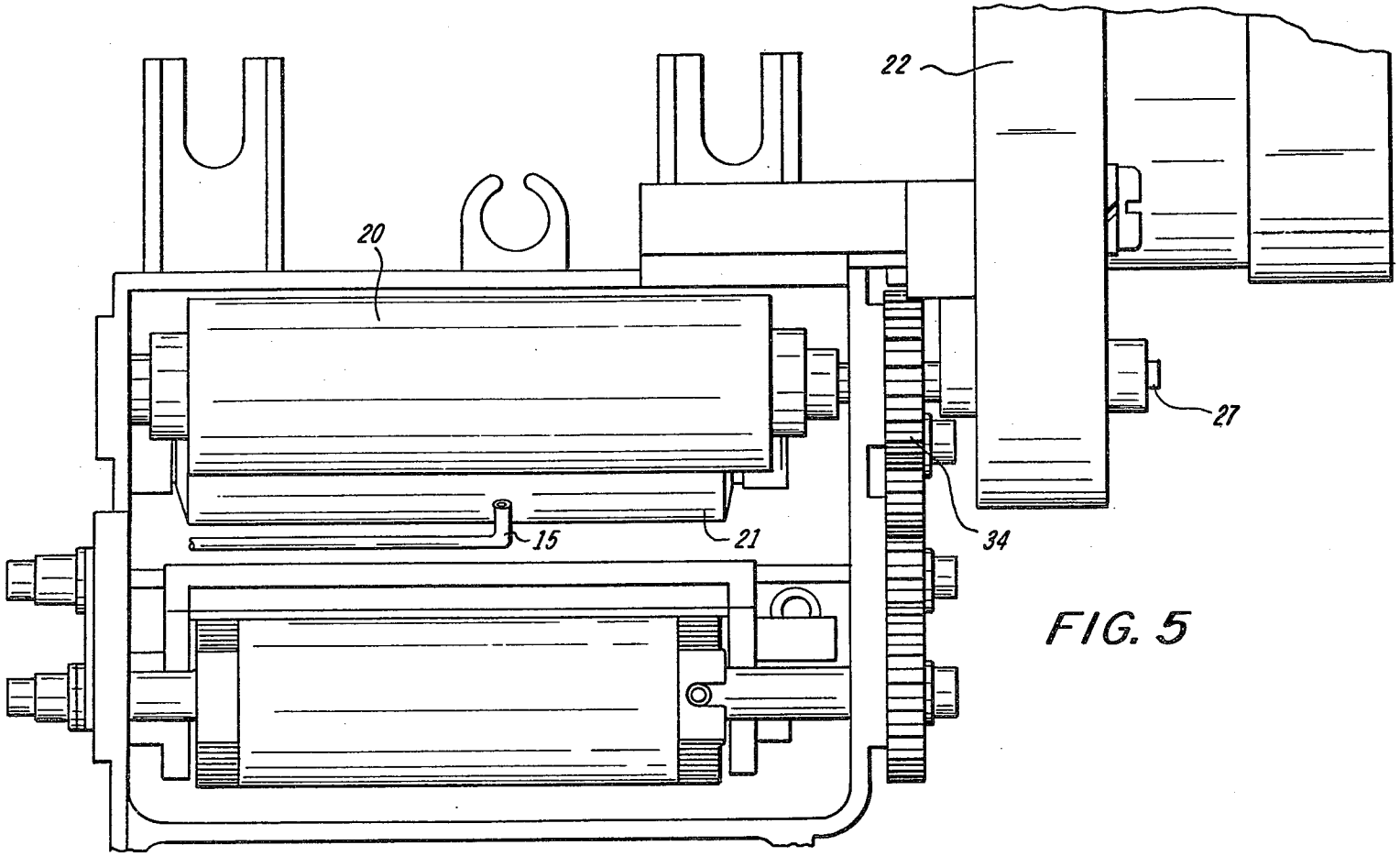
FIG. 5 is a top view of the entire station.

FIG. 5 is an overhead view of the entire assembly. A solid shaft 27 connects the drive motor 22 to the first gear 34 and the roll 20. Tube 15 supplies liquid to the bottom roll 21. Another tube, not shown, similarly supplies liquid to the other bottom roll 12.

While the invention has been described with reference to specific embodiments, it will be understood by those skilled in the art that various changes will be made and equivalents may be substituted for elements thereof without departing from the true spirit and scope of the invention. In addition, many modifications may be made without departing from the essential teachings of the invention.

We claim:

1. In a system for the development of a xerographic image comprising a reservoir of cleaning liquid, a cleaning station for the removal of toner particles from a xerographic plate after the image has been developed comprising:

a cylindrical cleaning roll comprising a foam outer covering adapted to rotate in contact with said plate to remove said toner particles from said plate, a cylindrical donor roll in contact with said cleaning roll at a nip, said donor roll being rotationally driven by said cleaning roll, means for delivering a flow of cleaning liquid to the surface of said donor roll at a point where the rotation of said donor roll will pull said liquid into the nip, creating there a standing wave of liquid, drain means for returning the cleaning liquid which flows downward from said standing wave into said reservoir, and means for rotating said cleaning roll.

2. The station of claim 1 wherein said cleaning liquid is the mixture of toner particles and liquid medium used during the liquid toner development of the image on said plate.

3. The station of claim 2 wherein said cleaning roll is an open cell polyurethane material over a plastic frame, and said donor roll is aluminum.

4. The station of claim 2 wherein the axis of said cleaning roll is adapted to travel along a line of points equidistant from the axis of said donor roll, thereby varying the overall height of the combination of cleaning and donor rolls, and a means for biasing the cleaning roll toward its upper position.

5. The station of claim 4 wherein said station comprises two sets of cleaning and donor rolls, only one set of which is adapted to vary in height.

6. The station of claim 5 wherein the set of rolls which is variable in height is narrower than the set of fixed height.

* * * * *